United States Patent [19]

Nayler et al.

[11] 4,411,454

[45] Oct. 25, 1983

[54] UNDERWATER WELLHEAD CONNECTOR

[75] Inventors: Douglas W. J. Nayler, Kingwood; John D. Smith, Houston, both of Tex.

[73] Assignee: NL Industries, Inc., New York, N.Y.

[21] Appl. No.: 202,942

[22] Filed: Nov. 3, 1980

[51] Int. Cl.[3] ..... F16L 35/00

[52] U.S. Cl. ..... 285/26; 285/119; 285/131; 339/16 R; 339/42

[58] Field of Search ..... 285/24, 25, 26, 27, 285/28, 29, 137 A, 332, 137 R, 119, 131, DIG. 21; 339/4 L, 117 R, 5, 6, 8, 15, 16 R; 166/65 M

[56] References Cited

U.S. PATENT DOCUMENTS

| | | | |
|---|---|---|---|
| 3,326,579 | 6/1967 | Fowler | 285/26 |
| 3,534,984 | 10/1970 | Shuey | 285/24 |
| 3,701,549 | 10/1972 | Koomey | 285/24 |
| 3,820,600 | 6/1974 | Baugh | 285/26 X |
| 3,839,608 | 10/1974 | Devries | 334/42 |
| 3,840,071 | 10/1974 | Baugh et al. | 285/26 X |
| 3,946,805 | 3/1976 | Peterman | 285/29 X |
| 3,966,235 | 6/1976 | Lewis | 285/28 X |
| 4,223,920 | 9/1980 | Bilderbeck | 285/24 |

*Primary Examiner*—Dave W. Arola

*Attorney, Agent, or Firm*—Browning, Bushman, Zamecki & Anderson

[57] ABSTRACT

The invention pertains to apparatus for connecting to a wellhead structure. Lower and upper female bodies define first and second receptacles disposed generally in coaxially aligned, end-to-end, communicative relation. A male body is received in both receptacles. The male body and upper female body have respective sets of inductive electric couplers matched in one-to-one relation. Several features facilitate effective use of such couplers: the couplers themselves have the edges of their heads chamfered from a point located just outwardly of the O.D's of their cores; an improved mounting arrangement aligns the two female bodies in stacked relation without the lower female body interfering with proper seating of the male body in the upper female body; an improved compensator system enhances play of one female body for precise centering with the other.

29 Claims, 11 Drawing Figures

UNDERWATER WELLHEAD CONNECTOR

SUMMARY OF THE INVENTION

The present invention pertains to apparatus for connecting to a wellhead structure, more specifically, an underwater wellhead. In conducting drilling and production operations, it is necessary to provide a plurality of signal communication means, such as hydraulic or electric lines, for controlling the functions of various device such as valves and the like located on and about the wellhead. For this purpose, it has become conventional to mount at least one female body on the wellhead structure. This body defines a receptacle having a number of signal communication means directed into that receptacle. The communication lines are completed by running a male body or pod into the female receptacle such that a plurality of signal communication means directed outwardly with respect to the pod mate with those of the female body. Examples of such apparatus are shown in U.S. Pat. Nos. 3,701,549, 3,840,071 and 3,820,600.

As indicated by these prior patents, the types of connections made up by such apparatus have been hydraulic, as opposed to electrical. This has been at least partially due to the fact that, through the use of proper port configuration and sealing, the hydraulic connections require less perfect alignment than would comparable electrical connections. In many instances in which electrical connections were either necessary or desirable, It has been necessary to use substantially different types of connecting structures from those typically employed in making hydraulic connections, and also to employ electrical connectors of the "hardware" type, as opposed to inductive couplers for example. See, e.g., U.S. Pat. No. 3,839,608. In other instances, it has been necessary to employ a diver to make up the electrical connections in order to ensure proper alignment.

The present invention provides a wellhead connector apparatus which allows signal communication connections to be made up automatically as one connector body is lowered into engagement with another with such precise alignment of the parts that electrical connections, such as inductive coupler elements, can be used in the same general type of apparatus used to make up hydraulic connections.

More specifically, the apparatus of the invention includes a first female body defining a first receptacle opening generally upwardly. First guide means are connected to the first female body and engagable with the wellhead structure for at least gross positioning of the first female body with respect to the wellhead structure. A second female body has a bore defining a second receptacle opening generally upwardly and downwardly, and engagable with the first female body with the receptacles in substantial coaxial alignment. Second guide means are connected to the second female body and engagable with the wellhead structure for at least gross positioning of the second female body with respect to such structure. Compensator means interconnect one of the female bodies with its respective guide means for substantial but limited relative lateral movement. Fine positioning means cooperative between the two female bodies serve to position those two bodies with their receptacles in substantial coaxial alignment, the compensator means allowing for the necessary relative movement of the female bodies to achieve such alignment as the second body is lowered into engagement with the first.

Because the second female body is typically run in with a male body or pod, the signal communication means of these two bodies may be pre-aligned upon assembly for running in. The receptacles of the two female bodies are preferably arranged in end-to-end relation, as opposed to nesting or surrounding relation. Then, as the second female body is run in with the male body, the aforementioned compensator means and fine positioning means not only position the two female bodies in substantial coaxial alignment, but also provide such alignment between the first female body and the male body via the second female body. Circumferential alignment means cooperative between the male body and each of the female bodies provide the necessary circumferential alignment so that all signal communication means in the male body are properly aligned with their mates in either the first or second female bodies.

The male body and second female body also include means for coaxially aligning the two, such as matching tapers on the receptacle of the second female body and the mating exterior surface of the male body or pod. As previously mentioned, coaxial alignment of the male body and first female body is achieved indirectly, i.e. via the second female body. There is also a slight clearance between the receptacle of the first female body and the outer surface of the male body received therein. These features cooperate to ensure that all three bodies are aligned as perfectly as if the two female bodies had been formed in one piece, but with all the advantages of dual, stacked female bodies and without the first female body interfering with proper seating of the male body in the second female body. Furthermore, if the male body is disconnected from the female bodies and raised from the underwater wellhead location, the same or another similarly tapered male body can subsequently be lowered into place, and these tapers, together with the fine positioning means cooperative between the two female bodies, will cause all three bodies to be brought into proper coaxial alignment as the male body settles into and seats on the tapered receptacle of the second female body. Again, the compensator means will provide for any necessary relative lateral movement between the female bodies during such re-alignment.

The compensator means is preferably associated with the second or upper of the two female bodies, and in preferred embodiments, provides for not only lateral but vertical movement of that body with respect to its guide means. This provides numerous advantages including compensation for thermal expansion and contraction of the various parts of the apparatus. As mentioned, the surfaces which provide for coaxial alignment of the male body and second female body are tapered surfaces, and therefore also provide for proper relative vertical positioning. The fine positioning means cooperative between the two female bodies also include tapered or partial conical surfaces so that they too provide for vertical as well as axial alignment. Thus, the vertical movement provided by the compensator means allows for the relative vertical positioning of the two female bodies and the male body to be determined soley by the two sets of matching tapered surfaces, uninhibited by the relative positions of the various guide means and/or other parts of the apparatus connected to these bodies.

As previously mentioned, one of the primary advantages of the improved alignment and positioning features of the invention is to make practical the use of inductive electric coupler means in the type of apparatus in question. Other features of the invention are associated with the coupler elements themselves and are instrumental in ensuring a proper size gap between mating coupler elements. For example, the heads of the coupler's have chamfered edges which allow the coupler cores to be placed as close as possible to their mates without interference with proper engagement of the male and female bodies.

The invention also includes an improved means for connecting the male body to the upper or second female body. More specifically, these connection means may be associated with the actuator for the latches which retain the male body in position by engagement with the first or lower female body. Thus, when the latter latches are actuated to engage the lower female body, the connection means between the male body and the upper female body are automatically disengaged.

Accordingly, it is a principal object of the present invention to provide an improved apparatus for connecting to a wellhead structure.

Another object of the present invention is to provide such an apparatus employing inductive electric coupler elements.

Still another object of the present invention is to provide improved means for relative positioning and alignment of the various connector bodies of such an apparatus.

Yet a further object of the present invention is to provide improved compensator means interconnecting a female body of such an apparatus with its respective guide means for substantial limited lateral movement.

Still other objects, features, and advantages of the present invention will be made apparent by the following detailed description of a preferred embodiment, the drawings, and the claims.

BRIEF DESCRIPTION OF THE DRAWINGS

FIG. 2 is a view similar to FIG. 1 showing the male body and associated apparatus assembled with the upper female body for running in.

DETAILED DESCRIPTION

Figure 6:
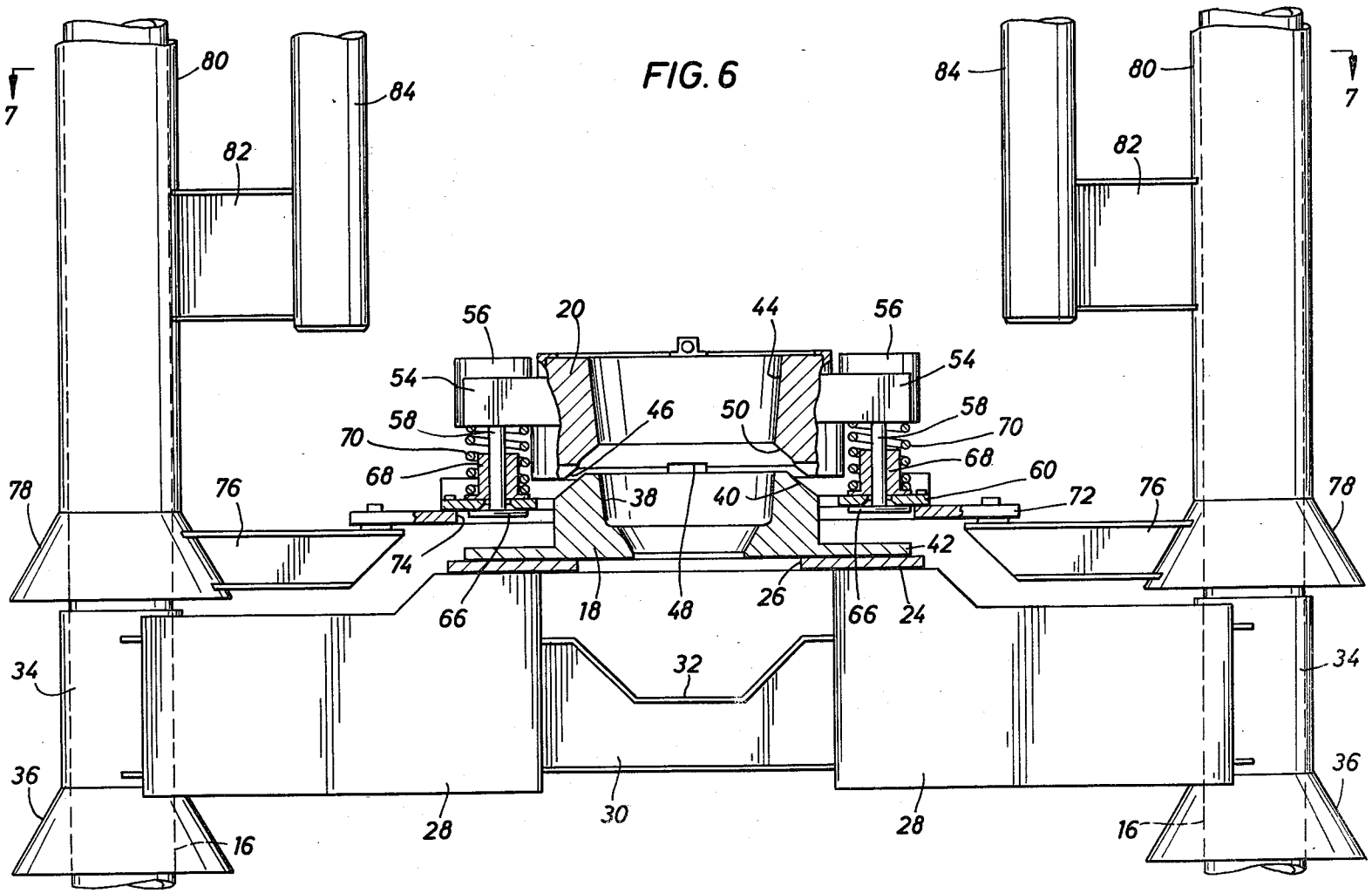
FIG. 6 is a view similar to those of FIGS. 1 and 2 of the female bodies in place on the wellhead structure and with the male body removed.
Figure 7:
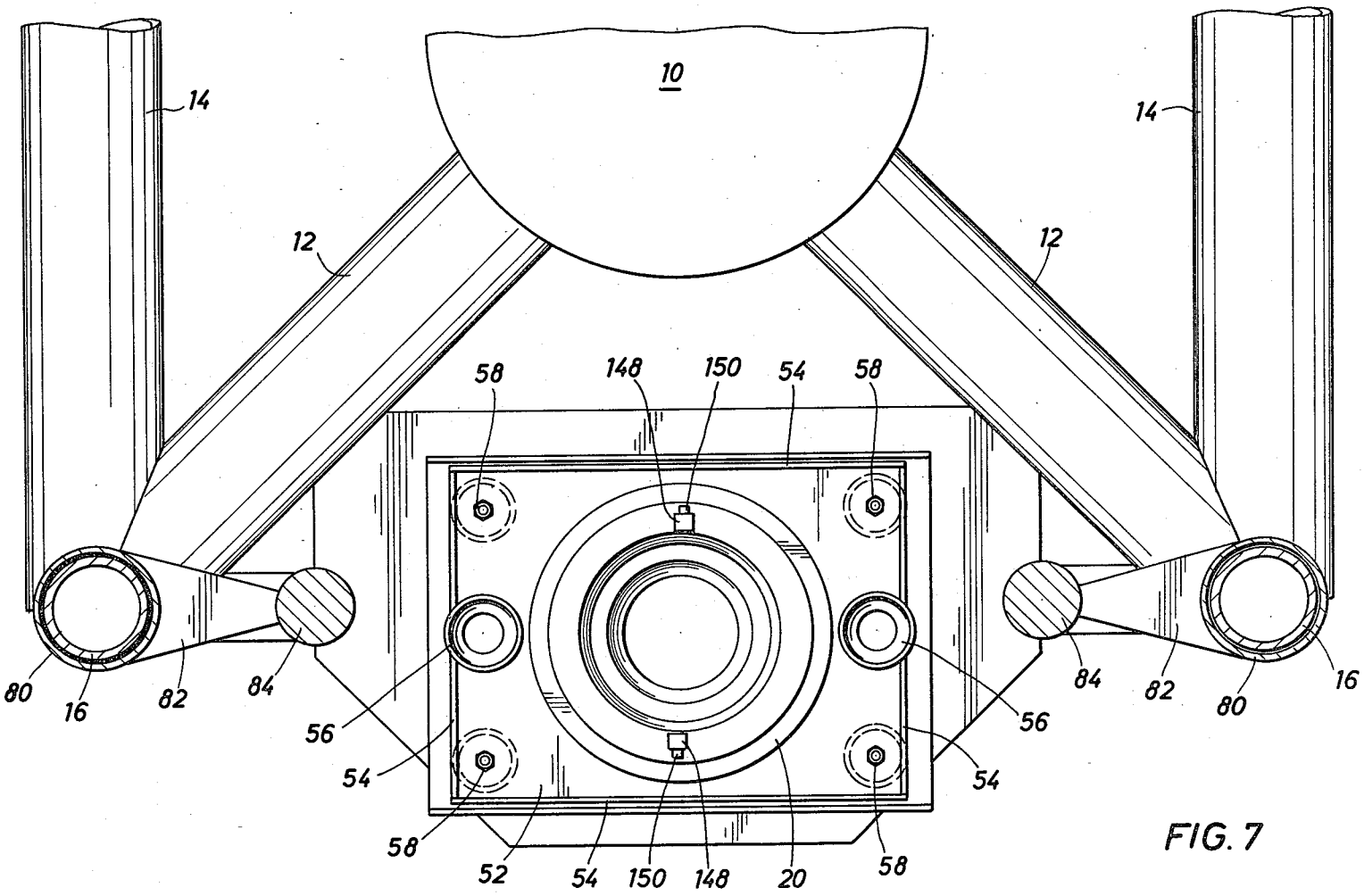
FIG. 7 is a transverse view taken along the line 7—7 in FIG. 6.

The present invention comprises apparatus for connection to underwater wellhead structure which is best seen in FIGS. 6 and 7. The wellhead structure is conventional and is shown in those figures only partially and in simplified form. Particularly, the wellhead structure includes a central body 10 to which are connected a number of horizontal structural support members, some of which are shown at 12 and 14. Laterally spaced to one side of central body 10 and secured to structural members 12 and 14, are a pair of parallel vertical guide posts 16. It is noted that, as used herein, terms such as "vertical," "horizontal," "upper," and "lower" refer to the apparatus as shown in the drawings, which represent it in use and in an ideal situation as on a perfectly level area of the ocean floor. It should be understood that these terms are used only in a general sense and for convenience, and are not intended to limit the scope of the invention.

The connector apparatus of the invention includes three main parts, a first or lower female body 18, a second or upper female body 20, and a male body or pod 22. Various figures will be referred to herein in describing different steps in the assembly and use of the apparatus. However, it will be helpful to also refer to the enlarged views of FIGS. 5, 8 and 9 throughout the description.

The first step in assembling the apparatus of the invention on the wellhead structure is emplacement of the lower female body 18. As shown in FIG. 6, body 18 has an annular flange 42 extending radially outwardly at its lower end. Flange 42 is rigidly affixed, as by welding, bolts, or any other suitable means, to a stab base plate 24 having a wide central vertical opening 26. Structural support members 28 are rigidly affixed to stab base plate 24 and extend laterally outwardly therefrom. As used herein, terms, such as "longitudinally," "radially," "laterally," "circumferentially," etc. refer to the longitudinal axes of bodies 18, 20 and 22, unless the context indicates another frame of reference. Structural support members 28 are interconnected by a bracing member 30 which is spaced downwardly from stab base plate 24 and further recessed as indicated at 32 along its upper surface to provide an open space beneath lower female body 18. The laterally outer extremities of structural support members 28 are fixed to respective tubular guide members. Each of these guide members has a cylindrical upper portion 34 and a frusto-conical lower portion 36, arranged with its large end lowermost.

To emplace the lower female member 18, any suitable running-in apparatus is secured to the attached parts 24, 28, 30, 34, and 36, and this assembly is lowered toward the wellhead structure. The apparatus may be roughly guided in this movement by flexible lines or the like (not shown) extending from the upper ends of vertical wellhead guide members 16 and through the tubular guide members 34, 36. As the apparatus reaches the upper ends of members 16, the frustoconical lower portions or skirts 36 of the tubular guides engage the upper ends of members 16 and guide them into the cylindrical upper portions 34. The apparatus is then further lowered with the members 16 and 34 providing proper gross positioning of the lower female body 18 with respect to the wellhead structure.

The lower female body 18 itself is generally annular in configuration, the upper portion of its central bore defining a first receptacle 38 for receipt of the lower portion of male body 22. Receptacle 38 is tapered radially inwardly and downwardly. Body 18 also has an upwardly facing annular surface 40 adjacent its upper end, surface 40 being tapered radially outwardly and downwardly for a purpose to be described more fully below.

Figure 1:
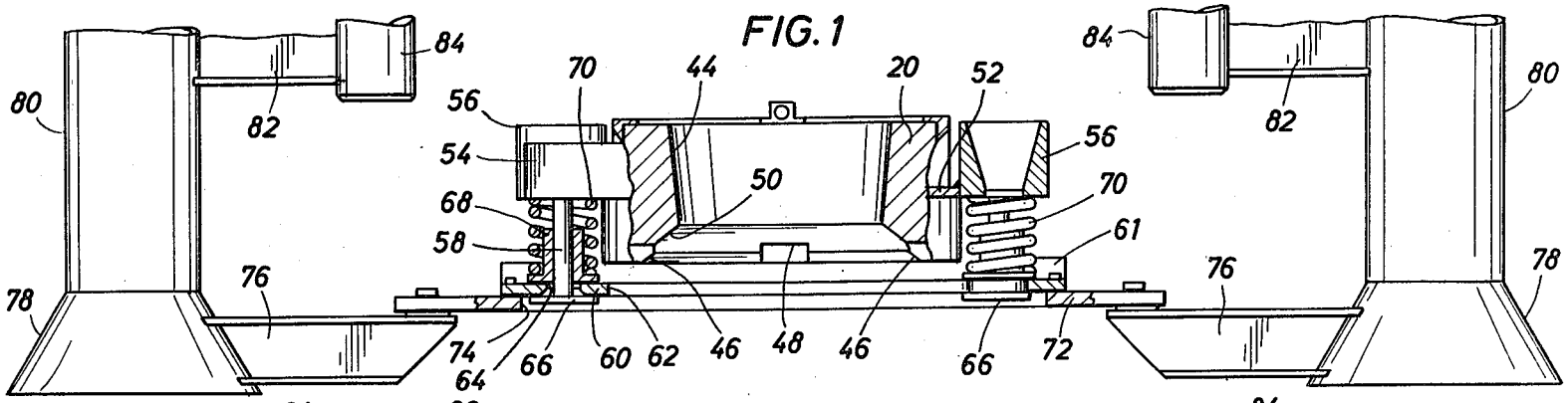
FIG. 1 is a side view, partly in section and partly in elevation, of an upper female body in accord with the present invention and the associated guide means and compensator means.
Figure 4:
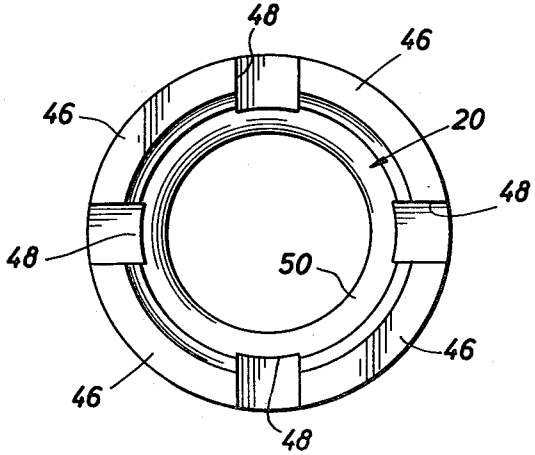
FIG. 4 is a bottom plan view of the upper female body of FIGS. 1 and 2.

After the lower female body 18 has been emplaced on the wellhead structure as described above, and its running-in apparatus removed, a tree with the upper female body 20 attached thereto is lowered onto the wellhead structure along with the male body 22. Male body 22 and the running-in assembly are also described more fully below. FIG. 1 shows body 20 and connected parts as they appear prior to engagement with the running-in assembly. Body 20 is generally annular, having a central vertical bore, the upper portion of which defines a second receptacle 44 for receipt of the upper portion of male body 22. The lower portion of the central bore of body 20 has a plurality of radially outwardly and downwardly tapered, and generally downwardly facing, surfaces 46 interspersed with cut-away areas 48. (See also FIG. 4.) Intermediate surfaces 46 and receptacle 44, the central bore of body 20 has a generally frustoconical relieved area 50.

Referring now also to FIG. 7, a box-like mounting structure is rigidly affixed to and extends laterally outwardly from body 20. The mounting structure includes a lower horizontal plate 52 having a central opening for receipt of a reduced diameter upper portion of body 20. Plate 52 rests on a shoulder **20*a* formed at the juncture of the large and small diameter portions of body 20 and is fixed thereto by screws 49. The mounting structure also includes four side walls 54 rigidly fixed to and extending upwardly from plate 52, the box-like mounting structure being open upwardly. The mounting structure 52, 54, carries a pair of upstanding positioning tubes 56. Tubes 56 have frustoconical inner surfaces, the larger ends disposed uppermost, and are aligned with vertical openings through plate 52. Tubes 56 are located approximately midway along two opposed side walls 54 of the mounting structure, and thus, on diametrically opposite sides of body 20**.

Plate 52 also carries four locator elements in the form of pins 58, each mounted generally adjacent a respective one of the four corners formed by the intersection of side walls 54 of the mounting structure. Each pin 58 has an upper portion **58*a* which is threaded and reduced in diameter. Thus an upwardly facing shoulder 58*b* is formed at the juncture of said upper portion 58*a* and the larger diameter lower portion 58*c*. The upper portion 58*a* of each pin is inserted upwardly through a respective aperture 55 in plate 52 so that shoulder 58*b* abuts the underside of plate 52. The pin is then fixed in place on plate 52 by a nut 57 threaded onto portion 58*a* above plate 52. A washer 59 is interposed between nut 57 and plate 52**.

A base member in the form of a plate 60 underlies the upper female body 20 and its mounting structure. A pair of short rims or flanges 61 extend upwardly from opposite sides of plate 60. Plate 60 has a large central bore 62 aligned with the central bore of body 20 as well as a plurality of smaller apertures 64 spaced laterally outwardly from bore 62 and positioned to receive lower portions **58*c* of respective locator pins 58. Each pin has its lower portion 58*c* extending through one of the apertures 64, and its lower end carries an abutment flange 66 wide enough to abut the lower surface of plate 60 about aperture 64 and thus limit upward movement of pin 58 with respect to plate 60. A respective generally annular bearing member 68 surrounds each pin 58 between plates 52 and 60. Bearing member 68 has an annular flange 68*a* extending ouwardly at its lower end. Flange 68*a* is wide enough to abut plate 60 about aperture 64 even with substantial lateral movement of pin 58 therein as described below. A respective helical compression spring 70 surrounds each bearing member 68. The upper end of spring 70 bears on the underside of plate 52. The lower end of spring 70 bears on the upper side of its respective flange 68*a*, which in turn rests on plate 60. Thus springs 70 urge plates 52 and 60 away from each other thereby resiliently supporting female body 20 and its mounting structure 52, 54 on plate 60** for substantial but limited relative vertical movement.

The above arrangement also provides for substantial but limited relative lateral movement between second female body 20 and plate 60 for purposes to be described more fully below. The upper surface of plate 60 serves as a support surface for supporting body 20 via its mounting structure 52, 54 and the interposed springs 70 and bearing members 68. The apertures 64 in plate 60 are substantially wider that the lower portions **58*c* of locator pins 58 received therein. It is primarily this size difference which allows for the aforementioned relative lateral movement between body 20 and plate 60. However, bearing members 68 provide guidance and control of such movement. More specifically, each bearing member 68 fits closely enough about its respective pin 58 to move laterally therewith. The underside of bearing member 68, including the underside of flange 68*a*, provides a planar bearing surface for sliding engagement with the upper support surface of plate 60. As previously mentioned, such bearing surface is wide enough to about plate 60 about aperture 64 regardless of the position of pin 58 therein. The bearing surfaces formed by the undersides of bearing members 68, and at least those portions of the upper surface of plate 60** which engage those bearing surfaces, are preferably smoothly finished and lubricated to facilitate relative sliding movement therebetween.

Thus, the assembly comprised of pins 58, bearing members 68, springs 70 and apertures 64 allows for both vertical and lateral movement between body 20 and plate 60, and will be referred to herein as the "compensator means" for body 20. The provision for lateral movement also allows for limited relative rotational or circumferential movement. Depending upon the clearances between the various parts of the compensator means, it may be designed to permit greater or lesser amounts of relative tilting movement in addition to the vertical and lateral movements mentioned above.

Plate 60 is bolted to a larger plate 72 having a central bore 74 substantially wider than the locus of the outer extremities of flanges 66. Plate 72 is in turn bolted to beams 76 which are rigidly connected to a complex of structural members commonly referred to as a "tree" to be mounted on the wellhead structure along with upper female body 20. These structural members include four guide tubes, two of which are shown in the drawings. Each guide tube has a frustoconical portion 78 connected to a respective one of the beams 76 and an upper cylindrical portion 80 adjoining the small upper end of frustoconical portion 78. The guide members 78, 80 are positioned to guide the apparatus shown in FIG. 1 on posts 16 of the wellhead structure in the same manner as the guide members 34, 36 of the lower female body. Thus, members 78, 80 provide gross positioning of the upper female body 20 with respect to the wellhead structure. The tree or structure connected to upper female body 20 also includes a pair of brackets 82 extending laterally inwardly from respective guide cylinders 80. Each bracket 82 has a vertical post 84 mounted at its inner end.

Figure 2:
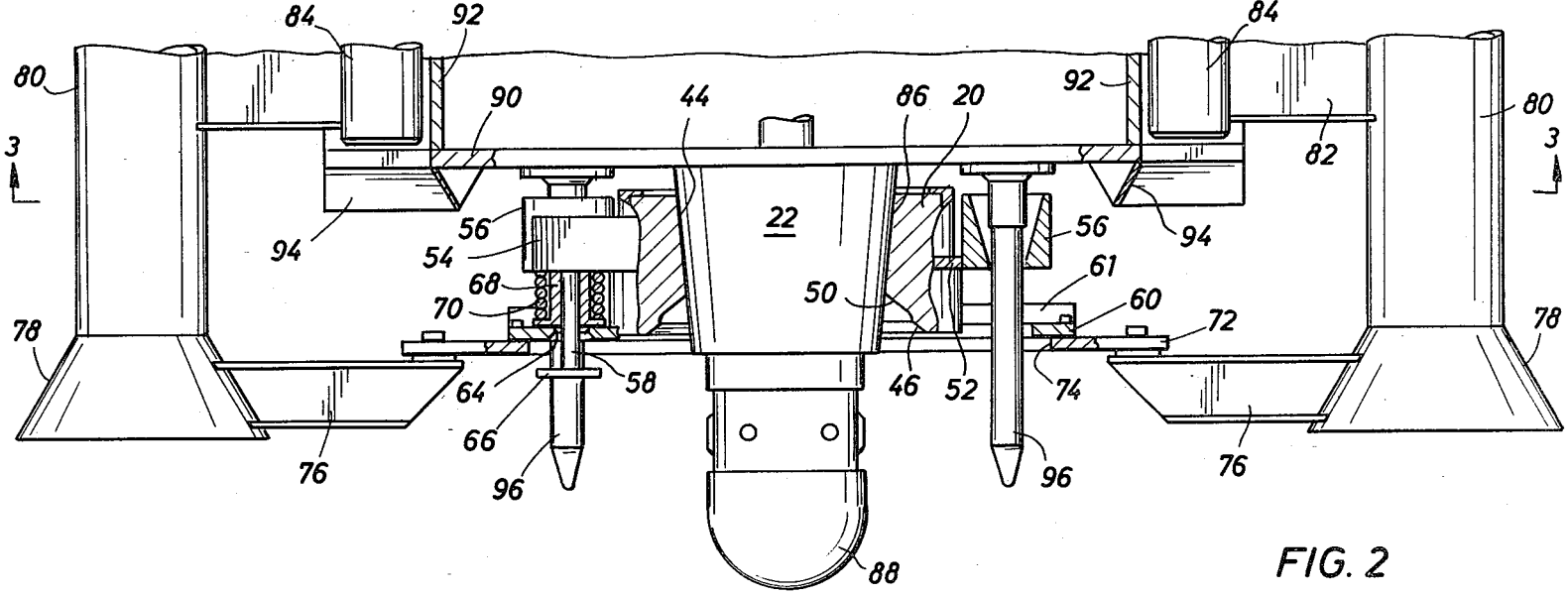
Figure 5:
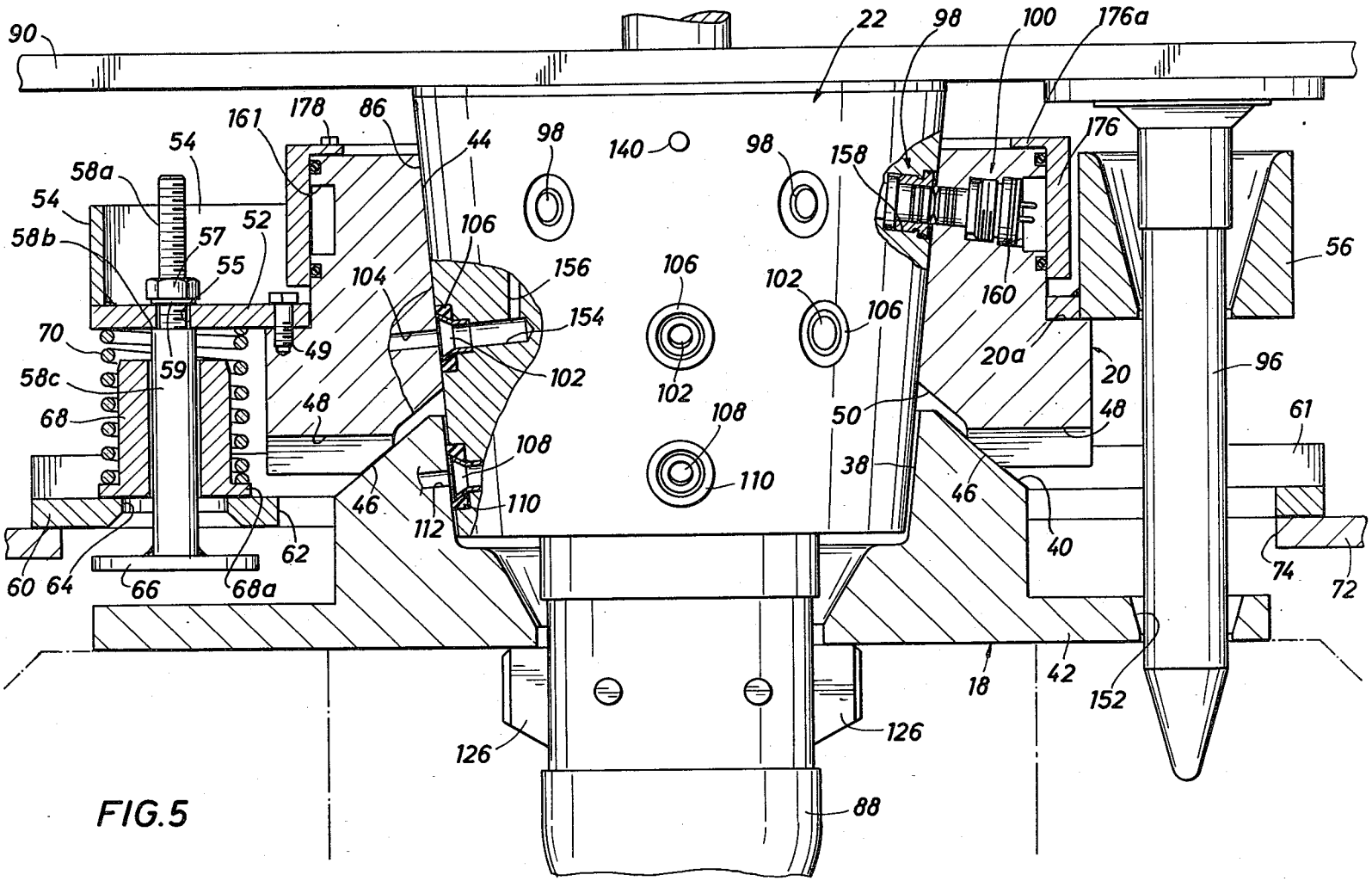
FIG. 5 is an enlarged partial sectional, partial elevational view of the male body and upper female body assembled with the lower female body.
Figure 8:
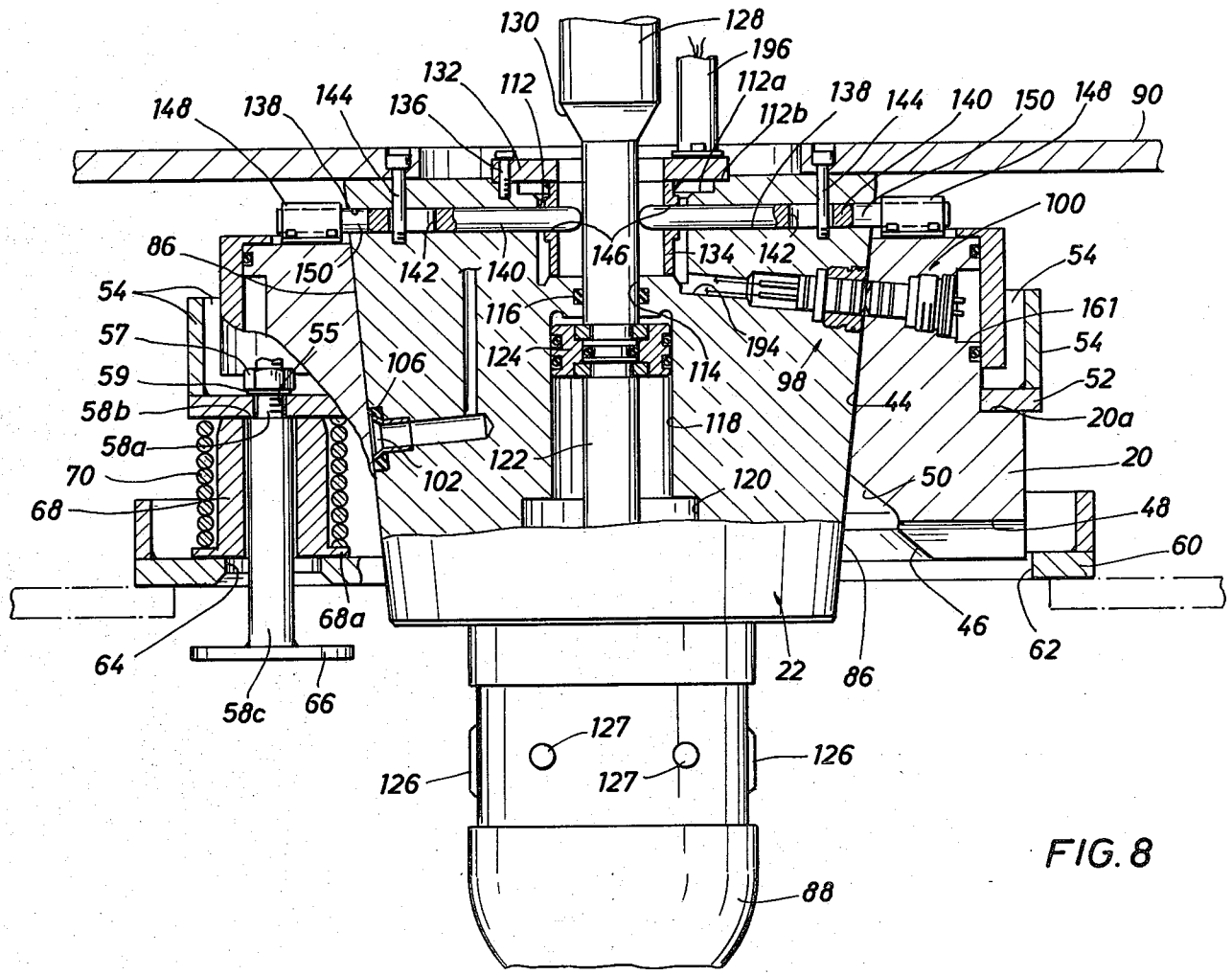
FIG. 8 is an enlarged partial sectional, partial elevational view of the male body and upper female body in the position of FIG. 2 but at right angles thereto.

As previously mentioned, the male body 22, which in the embodiment shown is in the form a "driller's pod," along with related apparatus, is run in with the upper female body 20 and tree. Referring to FIGS. 2, 5 and 8, pod 22 has a frustoconical outer surface 86 which is tapered radially inwardly and downwardly to match the taper of receptacle 44 in upper female body 20. A nose piece 88 is rigidly affixed to the lower end of pod 22, while a horizontal plate 90 is fixed to the upper end of the pod and extends laterally outwardly therefrom. Plate 90 carries a pair of guides in the form of laterally outwardly opening channel members 92 which receive posts 84 for providing gross positioning of pod 22 and the attached apparatus with respect to upper female body 20 and the attached tree as the former is lowered into engagement with the latter as shown in FIG. 2. (See also FIG. 3). Flared skirts 94 are formed at the lower ends of channel members 92 to enable such guide channels to skid over joints and other irregularities in the posts 84. A pair of positioning pins 96 are rigidly affixed to the lower side of plate 90 and extend downwardly therefrom. Pins 96 have downwardly and inwardly tapered ends and are positioned for receipt in respective tubes 56 on upper female body 20.

As best seen in FIG. 5, the driller's pod 22 has a plurality of signal communication means directed generally radially outwardly in its tapered outer face 86. More specifically, these include a first or upper set of vertically aligned, circumferentially spaced, signal communication means in the form of inductive electric coupler elements 98. These are designed to mate in one-to-one relation with respective ones of a set of inductive coupler elements 100 directed radially into receptacle 44 of upper female body 20.

Spaced from coupler elements 98, is a second set of signal communication means directed outwardly through pod 22 in the form of vertically aligned, circumferentially spaced hydraulic fluid ports 102. Upper female body 20 has a second set of signal communication means directed radially into receptacle 44 in the form of hydraulic ports 104. The ports 104 are vertically aligned and are spaced below coupler elements 100 by a distance corresponding to the distance between elements 98 and ports 102 of pod 22. Ports 104 are also circumferentially spaced by amounts corresponding to the spacing of ports 102, so that, when coupler elements 98 are matched in one-to-one relation with coupler elements 100, ports 102 will likewise be matched in one-to-one relation with respective ones of ports 104. Each of the ports 102 is substantially wider than the matching port 104 and carries an annular resilient seal 106 thereby ensuring communication without leakage between each set of matched ports 102 and 104. Finally, spaced below ports 102, pod 22 has a third set of vertically aligned, circumferentially spaced ports 108. Ports 108 are substantially identical to ports 102, and in particular, include annular resilient seals 110. Ports 108 are designed to match in one-to-one relation with respective ones of a set of ports 112 in lower female body 18.

In general, it is important to ensure precise coaxial alignment of male body or pod 22 with each of the female bodies 18 and 20, as well as precise relative vertical and circumferential positioning of these bodies, in order to ensure simultaneous proper alignment of the various sets of signal communication means. The width of hydraulic ports 102 and 108, together with the provision of the seals 106 and 110, will permit proper communication of the hydraulic ports while accommodating some misalignment. However, it is still desirable that the hydraulic ports in the male and female bodies be matched as perfectly as possible. More importantly, proper alignment of the various pairs of inductive electric coupler elements 98 and 100 is even more critical to ensure proper operation of these elements. The apparatus of the invention is designed to provide extremely precise alignment by means of various interengagable guide and positioning means which provide increasingly precise degrees of alignment as the various parts are assembled. Furthermore, the apparatus allows for maintenance of such alignment in the assembled apparatus even in the presence of thermal expansion or contraction of associated parts.

Referring again to FIG. 1, upper female body 20 and the connected tree is shown in position for engagement with the pod 22 and attached structures. It will be noted that prior to such engagement, mounting structure 52, 54 and the attached body 20 are urged upwardly by springs 70 to the full extent permitted by abutment flanges 66. As the male assembly is lowered onto the apparatus of FIG. 1, gross initial axial and circumferentially positioning is provided by receipt of guide posts 84 in channel members 92. As the pod 22 approaches female body 20, nose piece 88 will enter receptacle 44 to further guide pod 22 into a centered or coaxially aligned position with respect to body 20. As increasingly larger diameter portions of the tapered surface of pod 22 enter receptacle 44, this centering becomes more precise. In the meantime, pins 96 will have entered positioning tubes 56 carried by body 20. As the cylindrical portions of pins 96 enter smaller and smaller diameter portions of the bores through tubes 56, they provide increasingly fine adjustments of the axial and circumferential alignment of pod 22 with body 20. Finally, when the outer surface 86 of pod 22 seats in receptacle 44, a very precise degree of coaxial alignment is provided, along with precise relative vertical positioning, by virtue of the mating tapers of surfaces 86 and 44. Meanwhile, circumferential positioning is provided by pins 96 and tubes 56. Any lateral or circumferential movement of body 20 relative to plate 60 is permitted by the aforementioned compensator means 64, 58, 68, 70. To further ensure a very precise degree of coaxial alignment between body 20 and pod 22, their mating surfaces 44 and 86 are very carefully machined to extremely close tolerances, preferably using the same jig.

When surface 86 seats on receptacle 44, these surfaces act as stop means to limit further downward movement of pod 22 with respect to body 20. By continued action of the weight of the running-in assembly, pod 22 and body 20 will then be moved downwardly with respect to plate 60, compressing springs 70 as shown in FIG. 2. With the apparatus in this position, pod 22 is connected to body 20 by connection means shown in FIG. 8.

Figure 9:
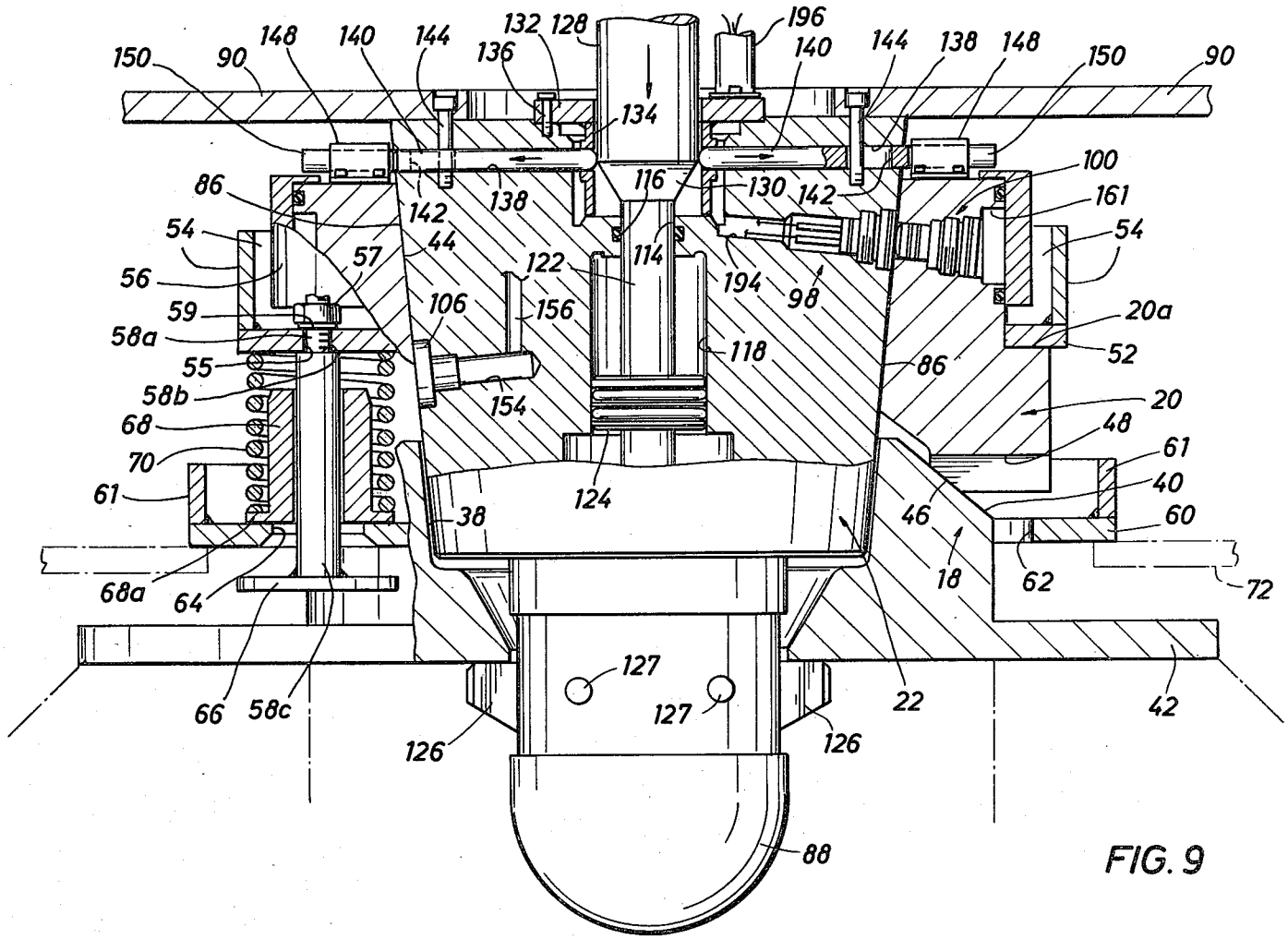
FIG. 9 is a view similar to that of FIG. 8 showing the parts assembled with the lower female body in the position of FIG. 5.
Figure 10:
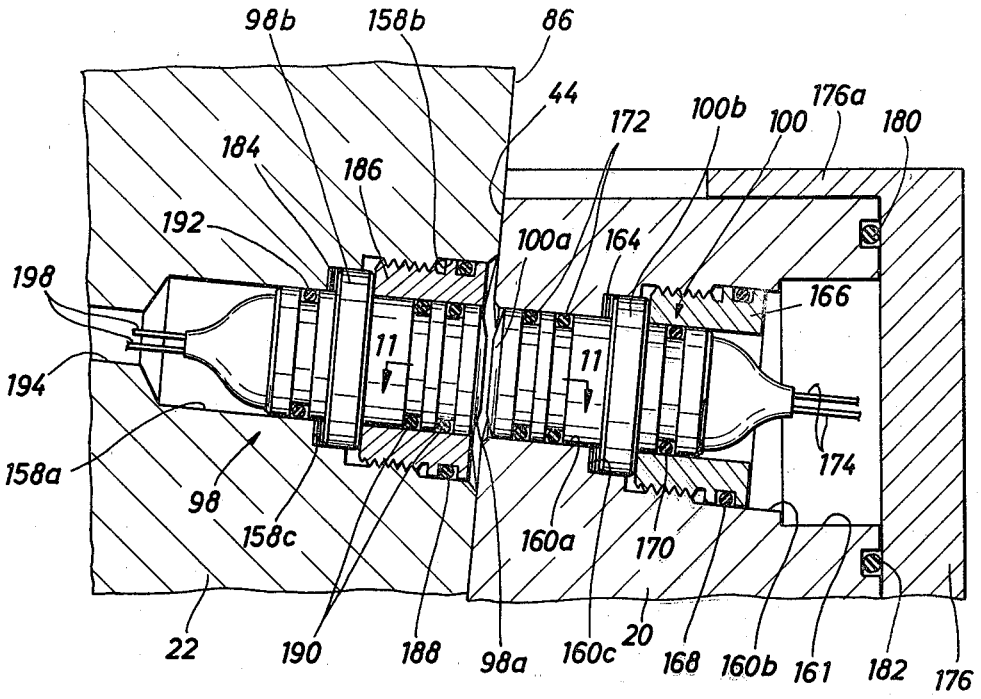
FIG. 10 is an enlarged detail vertical sectional view through one pair of inductive electric coupler elements.

Referring now to FIG. 8, pod 22 has a central longitudinal bore therethrough. This bore includes an upper relatively large diameter section 112. Just below section 112 is a relatively small diameter section 114 which carries an O-ring seal 116. Below section 114 is a relatively large diameter cylinder section 118, below which is an even larger diameter section 120. An actuator member is reciprocably mounted in bore 112-120. The actuator member includes a relatively small diameter main body portion 122 which is recessed to mount a piston assembly 124 intermediate its ends. Piston 124 is provided with the usual seals and mounting rings and is disposed in cylinder section 118 of the longitudinal bore of pod 22. In the running-in position shown in FIG. 8, piston 124 is located at the upper end of cylinder section 118. The lower end of main body 122 of the actuator member is connected by a toggle mechanism (not shown, but well known in the art) in section 120 to a pair of latches 126 mounted on pivot pins 127 in nose piece 88 for lateral extension and retraction. When piston 124 is in its upper postion as shown in FIG. 8, latches 126 are in their retracted positions. When piston 124 and the attached actuator member are lowered, latches 126 are extended as shown in FIGS. 5 and 9. Suitable hydraulic conduits (not shown) are provided in communication with cylinder section 118 for reciprocating piston 124 and the attached actuator member.

The part of main body portion 122 of the actuator member above piston 124 extends through small diameter section 114 of the longitudinal pod bore and engages seal 116 to seal cylinder section 118 from the open upper bore section 112. With piston 124 and main body portion 122 of the actuator in the upper position as shown in FIG. 8, the latter also extends through upper section 112 of the longitudinal pod bore. The actuator member further comprises a relatively large diameter portion 128 adjoined to portion 122 by a transitional tapered cam portion 130. The upper end of bore section 112 is counterbored at **112*a* and further counterbored at 112*b*. An annular plate 132 rests in counterbore 112*b* in spaced relation to counterbore 112*a* and projects inwardly of the inner diameter of bore section 112 below the counterbores. A cylindrical sleeve 134 is welded to the inner extremity of plate 132 and extends downwardly therefrom within bore section 112 but spaced inwardly from the inner diameter of the latter. Plate 132 is retained on the pod 22 by screws 136**.

Pod 22 also has a pair of generally radial bores 138 extending through its upper end and intersecting upper section 112 of its central longitudinal bore. A pair of ejector rods 140 are slidably mounted in respective bores 138. Each rod 140 has a slot 142 therein receiving a pin 144 extending through apertures in plate 90 and pod 22 and threaded into pod 22 below the respective bores 138. The pins 144, in cooperation with slots 142, limit the reciprocating movement of rods 140. In their inner positions as shown in FIG. 8, ejector rods 140 extend through apertures 146 in cylinder 134 and into longitudinal bore section 112 to approximately the outer surface of the small diameter portion 122 of the actuator member.

A pair of cylindrical raceway members 148 are mounted on the upper surface of body 20 and positioned such that their bores will be substantially aligned with bores 138 when pod 22 is properly seated in receptacle 44. Connector pins 150 are slidably mounted in raceway members 148 so that they may project into bores 138. When the male assembly has been engaged with the upper female body and related apparatus as shown in FIG. 2, pins 150 are pushed into bores 138 therby forcing ejector rods 140 into their inner position as shown in FIG. 8. The upper female body 20 is thus connected to pod 22, and the entire apparatus shown in FIG. 2 is ready for running-in.

The apparatus of FIG. 2 is suspended by any suitable means on a wireline or running-in string and lowered toward the wellhead structure, and more specifically, toward the lower female body 18 which has been previously mounted thereon. During this operation, tubular guide members or sleeves 78, 80 provide gross guidance and positioning of the apparatus with respect to the wellhead structure in substantially the same manner as guide sleeves 34, 36 for the lower female body 18. More specifically, wirelines or the like may be extended from the upper ends of guide posts 16 and through tubular guide members 78, 80. As the apparatus is lowered, the tapered portions 78 of the guide sleeves will engage the upper ends of posts 16 and direct them into the cylindrical portions 80 of the guide sleeves. This provides gross axial and circumferential positioning of the interconnected bodies 20 and 22 with the wellhead structure and the lower female body 18.

As nose piece 88 enters increasingly smaller diameter portions of the central bore of body 18, more precise centering or axial positioning is achieved. Such positioning, as well as proper circumferential positioning, is aided by entry of pins 96 into apertures 152 in flange 42 of lower female body 18. The compensator means 64, 58, 68, 70 allows both lateral and circumferential movement of bodies 20 and 22 jointly with respect to guide sleeves 78, 80 to permit these increasingly precise degrees of alignment. The receptacle 38 of lower female body 18 is radially inwardly and downwardly tapered at an angle to correspond to that of outer surface 86 of pod 22. Thus, as pod 22 passes downwardly into receptacle 38, further centering or coaxial alignment occurs. The ultimate or finest degree of coaxial alignment is achieved when tapered surfaces 46 of upper female body 20 seat on tapered surface 40 of lower female body 18. These surfaces not only provide for precise coaxial alignment of lower female body 18 with upper female body 20 and the attached male body 22, but also serve as stop surfaces for providing the proper relative vertical position of the two female bodies.

When surfaces 46 seat on surface 40, preventing further downward movement of upper female body 20, the compensator means, through expansion of springs 70, permit plate 60 and the connected guide sleeves and tree to continue moving downwardly and seat on the wellhead structure. Ideally, compensator means 64, 58, 68, 70 are then in an intermediate vertical position as shown in FIG. 5 whereby the compensator means may further serve to accomodate vertical movement due to thermal expansion and contraction of parts connected to the connector bodies 18, 20 and 22 without misaligning those bodies.

The fact that generally upwardly directed tapered surface 40 of lower female body 18 is inclined radially outwardly and downwardly, as opposed to radially inwardly and downwardly, tends to inhibit the accumulation of debris on that surface and minimize the possibility of interference with proper seating of surfaces 46 thereon. Cut away areas 48 further ensure against such interference by allowing spaces through which any debris, mud, or the like which has settled on surface 40 may be extruded as surfaces 46 press downwardly thereagainst. In other words, surfaces 40 and 46 are effectively self-cleaning.

Figure 3:
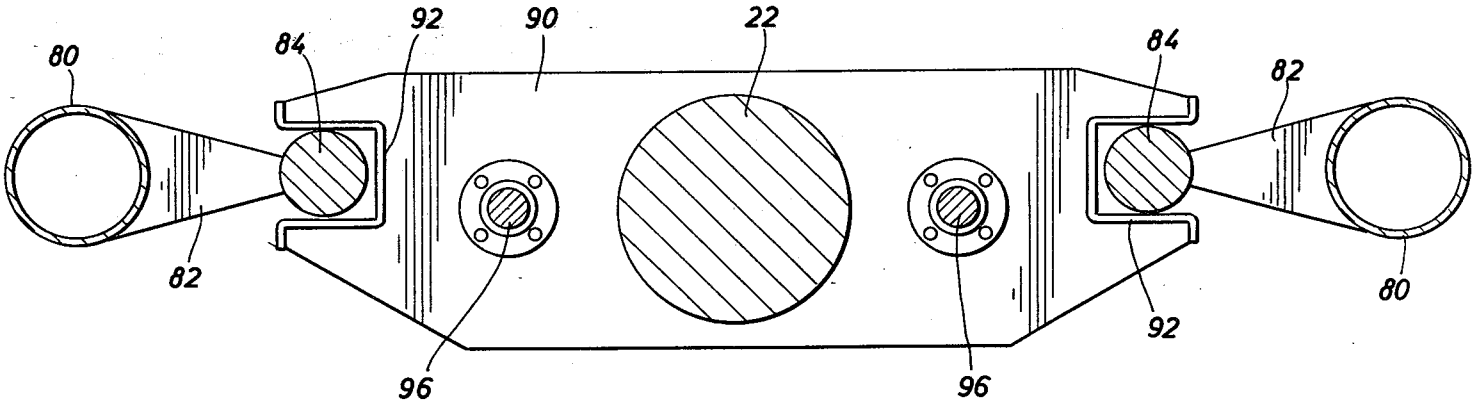
FIG. 3 is a transverse view taken along the line 3—3 in FIG. 2.

When body 20 is properly seated on body 18 as shown in FIG. 3, actuator 122, 128, 130 is forced downwardly by fluid pressure applied to the upper end of piston 124. This simultaneously extends latches 126, which lock beneath the underside of body 18, and forces tapered portion 130 and larger diameter portion 128 of the actuator member successively into alignment with rods 140 in bore section 112 of pod 22. As shown in FIG. 9, this will cam ejector rods 140 radially outwardly. When large diameter portion 128 of the actuator member has been brought into abutment with rods 140, they will have been forced outwardly to substantially their full extent thereby forcing connector pins 150 radially outwardly from bores 138. This releases the direct connection between pod 22 and upper female body 20 so that the pod is then positioned solely by the interengagement of its surface 86 with receptacle 44. Of course, engagement of latches 126 with the underside of body 18 will retain pod 22 with respect to both female bodies 18 and 20. When bodies 18, 20 and 22 are fully assembled as shown in FIGS. 5 and 9, pod 22 is centered or coaxially aligned with upper female body 20 by tapered surfaces 44 and 86, which surfaces likewise limit downward movement of pod 22 with respect to upper female body 20. Then, pod 22 and upper female body 20 are jointly centered with respect to lower female body 18 by surfaces 40 and 46, which likewise limit downward movement of body 20 and the pod 22 seated therein. It is important to note that such fine positioning of pod 22 with respect to lower female body 18 is thus accomplished indirectly only, i.e. via body 20, bodies 18 and 22 being sized so that there is a slight clearance between surfaces 86 and 38. As previously mentioned, latches 126 do retain the three bodies in properly assembled position, body 18 effectively being sandwiched between surfaces 46 and the upper surfaces of latches 126. However, said surfaces of latches 126, being coplanar and upwardly directed, do not affect the relative axial alignment of the bodies or downward movement of pod 22. The elimination of direct engagement between surfaces 86 and 38 ensures that body 18 will not interfere with proper seating of pod 22 in body 20, and thus with the maintenance of proper sized gaps between coupler elements 98 and 100, described more fully below. To put it another way, such arrangement provides virtually the same degree of precision in positioning of bodies 22 and 20 as would be achieved if the two female bodies were formed as a single, integral piece, yet with all the advantages of dual, stacked female bodies.

Referring again to FIG. 5, it can be seen that, with the three connector bodies 18, 20, and 22 thus properly seated with respect to one another, each inductive coupler element 98 is precisely aligned with its respective mate 100. Likewise, each hydraulic port 102 or 108 is aligned with its respective mate 104 or 112. As indicated above, receptacle 38 is tapered so as to lie parallel to surface 86 of pod 22, but is sized to be spaced slightly outwardly therefrom when surfaces 86 and 44 and surfaces 46 and 40 are properly seated. This is to prevent surface 38 from interfering with proper seating of the other surfaces. However, the spacing between receptacle 38 and pod 22, which has been exaggerated in FIG. 5 for purposes of illustration only, is very slight, and is accommodated by seals 110 to provide leakproof communication between ports 108 and 112.

When the pod 22 and the upper female body 20 have been properly seated with respect to lower female body 18, each of the inductive electric coupler elements 98 in pod 22 is matched or aligned with its respective mate 100 in female body 20. Likewise, each of the hydraulic ports 102 is aligned or matched with its respective mate 104 in body 20, while each hydraulic port 108 is algined or matched with its respective mate 112 in lower female body 18. Each of the hydraulic ports 102 communicates with fluid passageways through pod 22, e.g. as illustrated at 154 and 156 in FIG. 5. These passageways ultimately lead to hydraulic lines extending away from pod 22 to a suitable source of hydraulic fluid. As previously mentioned, the pod 22 which is illustrated in the drawings is a "driller's pod." In such a pod, these hydraulic lines, as well as electric lines to be described below, lead away from the pod in a bundle or umbilical line which extends upwardly to the drilling ship. In a production pod, to be described more fully below, the hydraulic and electrical lines ordinarily extend to an underwater source of electricity and hydraulic fluid. In either case, the ports 104 in body 20 lead into fluid passageways through that body and ultimately to hydraulic lines which extend to the various valves and other devices to be operated by the hydraulic fluid.

Ports 112 in the lower female body 18 likewise lead into fluid passageways through that body which in turn communicate with hydraulic lines to other operable wellhead devices. Although the mating ports 108 in the male body or pod 22 may communicate with a source of hydraulic fluid, in a driller's pod as shown, ports 108 ordinarily lead only to blind holes provided to carry seals 110 for sealing about ports 112. In a production pod, however, those ports which will mate with ports 112 would lead to hydraulic fluid supply lines.

Referring now to FIGS. 5, 8, 10, and 11, it is necessary that the matching pairs of inductive coupler elements 98 and 100 be disposed in extremely close proximity, but without protruding beyond respective surfaces 86 and 44 so as not to be susceptible to damage during running-in and/or to interfere with proper seating of those surfaces. Several expedients are employed to achieve this purpose. While extending generally radially, each coupler element 98 is mounted in a bore 158 of body 22 whose centerline is perpendicular to surface 86, rather than to true vertical. Likewise, coupler elements 100 are mounted in bores 160 of body 20 which are perpendicular to surface 44. Each coupler element 100 has a head **100*a* for opposition to the head 98*a* of the matching coupler element 98 in pod 22. Coupler elements 100 and 98 also have respective annular flanges 100*b* and 98*b* extending radially outwardly intermediate their ends. Bore 160 has a relatively large diameter portion 160*b* opening generally radially outwardly through body 20, and a relatively small diameter portion 160*a* opening generally radially inwardly into receptacle 44. A shoulder 160*c* is thus defined between large and small diameter portions 160*a* and 160*b* for cooperating with flange 100*b* in limiting inward movement of coupler element 100 as it is inserted through large diameter bore portion 160*b*. To more precisely position head 100*a* with respect to the surface defining receptacle 44, an annulus of laminated shim stock 164 is interposed between shoulder 160*c* and flange 100*b*. The shim stock 164 is comprised of a plurality of extremely thin layers of material which may be peeled off as needed to provide extremely precise positioning of head 100*a* with respect to surface 44**.

After the coupler element has been thus properly positioned, a retainer nut 166 is threaded into large bore portion **160*b* with its end in abutment with flange 100*b* to hold coupler element 100 in place. Nut 166 is sealed with respect to bore 160*b* by an O-ring 168. Coupler element 100 is sealed with respect to nut 166 by an O-ring 170, and with respect to small diameter bore portion 160***a* by O-rings 172. Wires 174 from coupler element 100 extend into an annular recess 161 in the side of body 20 communicating with bore portions 160*b*. From recess 161, wires 174 extend through passageways (not shown) to a conduit which in turn leads to a device to be operated by signals communicated between coupler elements 98 and 100. Recess 161 is closed by a sleeve 176 surrounding the upper end of body 20. Sleeve 176 has a radially inwardly extending flange 176*a* which rests on top of body 20 and is secured thereto by screws 178. Sleeve 176 is also sealed with respect to body 20 above and below recess 161 by O-rings 180 and 182.

Bore 98 has a relatively large diameter portion 158*b* opening radially outwardly through surface 86 of pod 22 and a smaller diameter portion 158*a* disposed inwardly thereof, a shoulder 158*c* being defined between bore portions 158*a* and 158*b*. The coupler element 98 is inserted through large bore portion 158*b*, shoulder 158*c* cooperating with flange 98*b* to limit inward movement of the coupler element. An annulus of laminated shim stock 184 is placed between shoulder 158*c* and flange 98*b* to precisely position head 98*a* with respect to surface 86. A nut 186 is then threaded into large diameter bore portion 158*b* in abutment with flange 98*b* to retain coupler element 98 in place. Nut 186 is sealed with respect to bore portion 158*b* by an O-ring 188. Coupler element 98 is sealed with respect to nut 186 by O-rings 190 and with respect to small diameter bore portion 158*a* by an O-ring 192. Bore portion 158*a* communicates with an even smaller diameter passageway 194, which in turn communicates with portion 112 of the central longitudinal bore of pod 22 in the protected area defined between the outer surface of bore portion 112 and sleeve 134. Wires 198 from coupler element 98 extend through passageway 194 and the annular space about sleeve 134 into a conduit 196 which in turn extends to the electrical power source.

Figure 11:
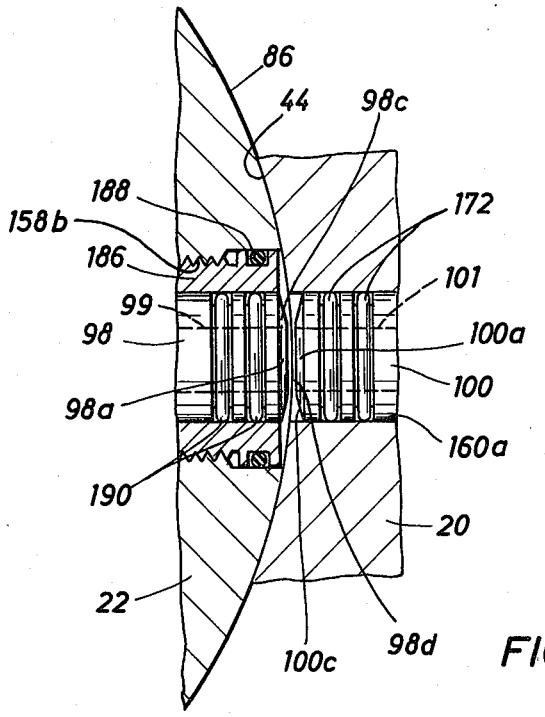
FIG. 11 is an enlarged transverse view taken along the line 11—11 in FIG. 10.

Proper signal communication between coupler elements 98 and 100 can be achieved if their heads 98*a* and 100*a* are placed in close proximity across the central portions thereof. If these heads were flat across the entire width of the coupler elements, one of two undesirable conditions would occur due to the convexity of surface 86 as shown in FIG. 11. Specifically, either the outer edge portions of coupler element 98 would protrude beyond the locus of the arc defined by surface 86, or coupler element 98 would have to be recessed into pod 22 by a distance which would create too large a gap between heads 98*a* and 100*a*. On the other hand, formation of head 98*a* to match the transverse curvature of pod 22 would be extremely difficult and expensive. However, only the central portions of heads 98*a* and 100*a*, i.e. the portions generally aligned with the cores 99 and 101 of the respective coupler elements, need be in close proximity. Therefore, the edges of head 98*a* are chamfered as indicated at 98*c* beginning at a point located slightly radially outwardly of the O.D. of core 99. This permits the flat central end surface 98*d* of head 98*a* to be placed extremely close to the locus of the arc of surface 86, and thus to head 100*a*, without any portion of head 98*a* extending beyond that locus. Head 100*a* is similarly chamfered about its edges as indicated at 100*c* beginning at a point located slightly radially outwardly of the O.D. core 101. The space between heads 98*a* and 100*a* has been slightly exaggerated in FIGS. 10 and 11 for purposes of illustration. However, by means of the expedients described above, the central portions of these heads can in fact be positioned in extremely close proximity to one another without protruding beyond the arcs defined respectively by surfaces 86 and receptacle 44.

Referring once again to FIGS. 5, 9, and 6, once any desired operations on or about the wellhead have been performed by means of the electric and hydraulic connections made up by pod 22 and female bodies 18 and 20, it may be desired to remove pod 22. This is done by applying fluid pressure to the underside of piston 124 to return the actuator member 122, 128, 130 to its upper position thereby retracting latches 126. However, such movement will not alter the positions of connecting pins 150, so that pod 22 will then be disconnected from both female bodies 18 and 20 and can be raised upwardly from the wellhead structure. FIG. 6 shows the two female bodies 18 and 20 and connected apparatus after pod 22 has been removed. It will be noted that, with the weight of pod 22 and the associated assembly removed from female body 20, it will be urged upwardly by springs 70 until abutment flanges 66 touch the underside of plate 60.

Subsequently, either the same driller's pod 22, or another pod known as a "production pod," may be connected to female bodies 18 and 20. The production pod would, for purposes of the present invention, be substantially identical in external configuration to pod 22 and would have connected thereto guidance apparatus and a nose piece similar to those of the driller's pod 22. Thus, for present purposes, the following description of re-engaging of the driller's pod 22 with the female bodies 18 and 20 will be descriptive of the manner in which a production pod would be engaged with those bodies.

Specifically, the pod 22 along with all the connected structures, including the guide structure 90, 92, is lowered toward the upper female body 20. Channel members 92 would engage posts 84 on the tree carried by upper female body 20 to provide gross axial and circumferential positioning of pod 22 with respect to female body 20. As the nose piece 88 enters receptacle 44 followed by increasingly larger diameter portions of pod 22, finer and finer degrees of coaxial alignment of pod 22 and female body 20 are obtained. Meanwhile, pins 96 enter tubes 56 to provide an intermediate degree of axial alignment along with a relatively fine degree of circumferential alignment. When pod 22 seats in receptacle 44, it can begin urging body 20 downwardly toward body 18 until surfaces 46 and 40 engage one another thereby providing a fine degree of coaxial alignment between lower female body 18 and upper female body 20 and the then aligned male body 22. Meanwhile, pins 96 will have entered apertures 152 in flange 42 of female body 18 to provide the necessary circumferential alignment of body 18 with bodies 20 and 22. In short, the apparatus would resume the relative positions shown in FIG. 5 and latches 126 could be re-extended to hold the connector bodies in that position. As before, the compensator means connecting female body 20 with plate 60 would allow for any necessary lateral, circumferential, or longitudinal movement of body 20 relative to bodies 18 and 22 in order to achieve the desired fine degree of alignment.

As previously mentioned, a production pod could be guided into place, with increasingly fine degrees of alignment, on bodies 18 and 20 in substantially the same manner, the primary difference between a production pod and a driller's pod being the location of the source from which it receives its electrical and hydraulic fluid power.

The above description represents one preferred embodiment of the invention, and it should be understood that numerous modifications could be made. Accordingly, it is intended that the scope of the invention be limited only by the claims which follow.

We claim:

1. Apparatus for connecting to a wellhead structure comprising:

a first female body defining a first receptacle opening generally upwardly;

first guide means connected to said first female body and engagable with said wellhead structure for at least gross positioning of said first female body with respect to said wellhead structure;

a second female body having a bore defining a second receptacle opening generally upwardly and downwardly, and engagable with said first female body with said receptacles in substantial coaxial alignment;

second guide means connected to said second female body and engagable with said wellhead structure for at least gross positioning of said second female body with respect to said wellhead structure;

compensator means interconnecting one of said female bodies with the respective one of said guide means for substantial but limited lateral movement of said one female body with respect to said one guide means; and fine positioning means cooperative between said female bodies for positioning said female bodies with said receptacles in substantial coaxial alignment.

2. The apparatus of claim 1 wherein said compensator means further connects said one female body to said one guide means for substantial but limited relative vertical movement.

3. The apparatus of claim 2 wherein said one female body is said second female body.

4. The apparatus of claim 3 further comprising a base member rigidly connected to said second guide means and defining a generally horizontal planar support surface, said base member having a plurality of apertures extending generally vertically therethrough adjacent said support surface;

said compensator means comprising:

a plurality of generally vertically extending locator elements substantially narrower than said apertures and spaced laterally from said second female body, each of said locator elements having one end rigidly affixed to said second female body and the other end extending through a respective one of said apertures;

a plurality of abutment members wider than said apertures each rigidly adjoining said other end of a respective one of said locator elements;

a plurality of bearing elements each carried by a respective one of said locator elements for lateral movement therewith and defining a planar bearing surface slidably engageable with said support surface; and means resiliently biasing said abutment member toward said base member.

5. The apparatus of claim 4 wherein the one end of each of said locator elements is its upper end, and the other end is its lower end, said support surface being an upwardly facing surface of said base member.

6. The apparatus of claim 4 further comprising mounting means rigidly adjoined to said second female body and defining a generally downwardly facing reaction surface opposed to said support surface of said base member, said locator elements having their upper ends affixed to said mounting means and extending downwardly therefrom;

wherein each of said bearing members comprises a generally cylindrical body surrounding the respective locator element and having a flange extending radially outwardly at its lower end, said lower end and said flange defining said bearing surface; and wherein said biasing means comprises a plurality of helical compression springs each generally surrounding a respective one of said bearing members and having its lower end abutting the upper surface of said flange and its upper end abutting said reaction surface of said mounting means.

7. The apparatus of claim 3 wherein said first female body comprises generally upwardly facing first stop surface means, and said second female body comprises generally downwardly facing second stop surface means engagable with said first stop surface means to limit downward movement of said second female body with respect to said first female body, and said stop surface means being disposed to position said receptacles in end-to-end relation when so engaged.

8. The apparatus of claim 7 wherein said stop surface means are correspondingly tapered whereby they serve as at least a part of said fine positioning means.

9. The apparatus of claim 8 wherein said stop surface means are tapered radially outwardly and downwardly.

10. The apparatus of claim 9 wherein said first stop surface means is a continuous annular surface, and said second stop surface means comprises a plurality of circumferentially spaced surfaces.

11. The apparatus of claim 8 further comprising a male body for disposition in said coaxially aligned receptacles and having a set of circumferentially spaced apart, generally radially outwardly directed signal communication means therein, said second female body having a set of signal communication means directed generally radially into said second receptacle and circumferentially spaced apart to match in one-to-one relation with said signal communication means of said male body, said male body and said second female body having interengageable stop means for limiting downward movement of said male body in said second female body;

said apparatus further comprising circumferential positioning means cooperative between said male body and said second female body for circumferentially aligning said signal communication means of said male body in one-to-one relation with said signal communication means of said second female body.

12. The apparatus of claim 11 wherein the inner surface of said second female body defining said second receptacle is tapered radially inwardly and downwardly, and said male body has an outer surface correspondingly tapered, whereby said inner surface of said second female body and said outer surface of said male body comprise said stop means.

13. The apparatus of claim 12 wherein the inner surface of said first female body defining said first receptacle is tapered radially inwardly and downwardly at an angle such that, when said stop surface means of said female bodies are engaged, and said stop means of said male body and said second female body are also engaged, said inner surface of said first female body is parallel to but spaced slightly outwardly from the lower portion of said outer surface of said male body disposed therein.

14. The apparatus of claim 13 further comprising circumferential positioning means on said first female body cooperative with said circumferential positioning means of said male body for circumferentially aligning said male body and said first female body.

15. The apparatus of claim 14 further comprising connection means for releasably connecting said male body to said second female body, said circumferential positioning means of said male body and said first female body being further operative to provide a degree of coaxial alignment of said receptacles intermediate that of said guide means and said fine positioning means.

16. The apparatus of claim 11 further comprising connection means for releasably connecting said male body to said second female body.

17. The apparatus of claim 16 wherein said male body has a pair of generally radical bores opening outwardly therethrough;

and said connection means comprises a pair of connector elements mounted on said second female body for movement into and out of respective ones of said radial bores;

said apparatus further comprising a pair of ejector elements each reciprocably mounted in a respective one of said radial bores for abutment with the respective connector element;

said male body further having a longitudinal bore intersecting said radial bores for receipt of inner ends of said ejector elements; and an actuator member reciprocably mounted in said longitudinal bore of said male body, said actuator member having a relatively narrow portion for disposition adjacent said ejector elements in an inner position permitting receipt of said connector elements in said radial bores, and a relatively wide portion movable into alignment with said ejector elements to force said ejector elements radially outwardly thereby ejecting said connector elements from said radial bores.

18. The apparatus of claim 17 further comprising latch means carried by said male body for engagement with said first female body to retain said male body in said receptacles, said actuator member being operatively connected to said latch means such that movement of said actuator member to eject said connector elements will further operate to simultaneously urge said latch means into latching engagement with said first female body.

19. The apparatus of claim 11 wherein at least some of said signal communication means in said male body, and the respective matching signal communication means in said second female body comprise inductive electric coupler elements.

20. The apparatus of claim 19 wherein said male body has an outer surface which is convex in transverse cross section, said inductive coupler elements of said male body have head portions facing outwardly adjacent said outer surface, and said head portions have chamfered edges.

21. An apparatus for connecting to a wellhead structure comprising:

a first female body defining a first receptacle opening generally upwardly and tapering radially inwardly and downwardly;

a second female body for disposition generally above said first female body having a bore defining a second receptacle opening generally upwardly and downwardly and tapering radially inwardly and downwardly parallel to said first receptacle;

said first female body having generally upwardly facing first stop surface means, and said second female body having generally downwardly facing second stop surface means, said first and second stop surface means being correspondingly axially and radially tapered and engageable with each other to limit downward movement of said second female body with respect to said first female body and position said receptacles in coaxially aligned end-to-end relation;

and a male body having an outer surface tapering radially inwardly and downwardly parallel to said receptacles for disposition therein, said outer surface of said male body having an upper portion engageable with the inner surface of said second female body defining said second receptacle to limit downward movement of said male body with respect to said second female body and position said male body in coaxial alignment with said second receptacle and a lower portion directly surrounded by said first receptacle when said upper portion is so engaged;

said first receptacle being sized so as to be spaced slightly outwardly from the enclosed portion of said outer surface of said male body when said outer surface of said male body and said inner surface of said second female body are so engaged.

22. The apparatus of claim 21 wherein said first and second stop surface means are tapered radially outwardly and downwardly.

23. The apparatus of claim 22 wherein said first stop surface means is an outer, continuous, annular surface, and said second stop surface means comprises a plurality of circumferentially spaced surfaces.

24. The apparatus of claim 21 wherein said male body has a set of circumferentially spaced apart, generally radially outwardly directed signal communication means therein, said second female body having a set of signal communication means directed generally radially into said second receptacle and circumferentially spaced apart to match in one-to-one relation with said signal communication means of said male body;

said apparatus further comprising circumferential positioning means cooperative between said male body and said second female body for circumferentially aligning said signal communication means of said male body in one-to-one relation with said signal communication means of said second female body.

25. The apparatus of claim 24 further comprising latch means carried by said male body for engagement with said first female body to retain said male body against upward movement in said receptacles.

26. The apparatus of claim 24 wherein at least some of said signal communication means in said male body, and the respective matching signal communication means in said second female body comprise inductive electric coupler elements.

27. Apparatus for connecting to a wellhead structure comprising:

a female body defining a receptacle opening generally upwardly and having a set of inductive electric coupler elements mounted therein, said coupler elements being circumferentially spaced apart and directed generally radially into said receptacle;

a male body having an outer surface, convex in transverse cross section seatable in said receptacle, and having a set of inductive electric coupler elements mounted therein directed generally radially outwardly through said outer surface and circumferentially spaced apart to match in one-to-one relation with said coupler elements of said female body when said outer surface is so seated, each of said coupler elements of said male body having an internal core of substantially smaller outer diameter than said coupler element as a whole and a head portion facing outwardly adjacent said outer surface of said male body, said head portion having its edges chamfered from a point located slightly radially outwardly of the outer diameter of said core and means cooperative between said male and female bodies for aligning said sets of inductive electric coupler elements in one-to-one relation.

28. The apparatus of claim 27 wherein each of said coupler elements of said female body has an internal core of substantially smaller outer diameter than said coupler element as a whole and a head portion facing into said receptacle, said head portion having its edges chamfered from a point located slightly radially outwardly of the outer diameter of said core.

29. The apparatus of claim 28 wherein said receptacle and said outer surface of said male body are correspondingly tapered downwardly and radially inwardly, and wherein each of said coupler elements has its centerline disposed substantially perpendiculr to said correspondingly tapered surfaces.

* * * * *

UNITED STATES PATENT AND TRADEMARK OFFICE

CERTIFICATE OF CORRECTION

PATENT NO. : 4,411,454

DATED : October 25, 1983

INVENTOR(S) : Douglas W. J. Nayler; John D. Smith

It is certified that error appears in the above—identified patent and that said Letters Patent is hereby corrected as shown below:

In Column 16, line 1, delete "4" and insert therefor --5--.

In Column 20, line 16, delete "perpendiculr" and insert therefor --perpendicular--.

Signed and Sealed this

*Twelfth* Day of *February 1985*

[SEAL]

*Attest:*

DONALD J. QUIGG

*Attesting Officer* *Acting Commissioner of Patents and Trademarks*